US005649580A

United States Patent [19]

Mierau et al.

[11] Patent Number: 5,649,580

[45] Date of Patent: Jul. 22, 1997

[54] ASSEMBLY FOR INFEED TABLE

[75] Inventors: Cameron Dean Mierau, Portland; Douglas Edward Amende, Salem, both of Oreg.

[73] Assignee: U.S. Natural Resources, Inc., Vancouver, Wash.

[21] Appl. No.: 610,833

[22] Filed: Mar. 5, 1996

[51] Int. Cl.[6] ..... B27B 31/00; B27B 1/00; B27C 1/12

[52] U.S. Cl. ..... 144/248.4; 83/367; 144/245.2; 144/357; 198/468.2

[58] Field of Search ..... 144/242.1, 246.1, 144/248.4, 250.3, 250.16, 250.17; 414/446.7; 198/434, 468.2, 624; 83/13, 364, 365, 367, 371; 364/474.09

[56] References Cited

U.S. PATENT DOCUMENTS

| | | | |
|---|---|---|---|
| 4,009,632 | 3/1977 | Detjen . | |
| 4,250,937 | 2/1981 | Detjen . | |
| 4,386,641 | 6/1983 | Horen | 144/329 |
| 5,088,363 | 2/1992 | Johns et al. | 144/357 X |
| 5,243,888 | 9/1993 | Bowlin . | |
| 5,257,101 | 10/1993 | Lee . | |
| 5,368,080 | 11/1994 | Hamel | 144/357 |
| 5,429,161 | 7/1995 | Allard | 144/357 |

*Primary Examiner*—W. Donald Bray
*Attorney, Agent, or Firm*—Robert L. Harrington

[57] ABSTRACT

A mechanism for elevating and/or shifting a log infeed table to position a log received on the infeed table for a subsequent operation. The mechanism has sets of opposed paired crank arms pivotally mounted on supports. The infeed table is mounted on supporting shafts extending between the crank arms with the supporting shaft offset from the pivot axis of the crank arms. The crank arms are pivoted by an actuator coupled to a beam extended between one pair of the crank arms. All of the sets of paired crank arms have their beams coupled together by flexible couplings such that all of the sets of crank arms will pivot in unison. As the crank arms are pivoted by the actuator, the infeed table is raised or lowered. The supporting shafts are slidably movable in the cranks arms. Separate actuators are provided to move the supporting shaft in the crank arms to shift the infeed table transverse to the flow path of the infeed table.

5 Claims, 2 Drawing Sheets

ASSEMBLY FOR INFEED TABLE

FIELD OF THE INVENTION

This invention relates to a log infeeder, e.g., for feeding logs to chip-and-saw apparatus, and more particularly to a mechanism for adjusting the height of the infeeder.

BACKGROUND OF THE INVENTION

Maximizing the production of lumber from each log is a major objective of sawmills of today. Many different types of machinery or apparatus are applied to this task. An example is the chip-and-saw apparatus. A log is scanned and a computer determines a precise rectangular cross section extended lengthwise down the log that can be derived from the log and the precise cuts that can be made to maximize the production of lumber from that cross section. The log is then passed through a series of chippers that discriminately removes the wood of the log periphery to generate the desired cross section. Included is a bottom chipper that squares (or flattens) the log bottom, side chippers that square the log sides, and a top chipper that squares the log top, all precisely in accordance with the dictated rectangular cross section determined by the computer.

The chippers have to be adjusted relative to each log to be sawn in order to accomplish the desired flattening (or opening) of the sides. Typically the bottom chipper is fixed and the log infeed or conveyor path, as defined by the height of the infeed table is raised or lowered relative to the bottom chipper. The side chippers are moved in and out relative to a center line and the log infeed path is laterally adjusted to align the log with that center line. The top chipper is raised and lowered as needed.

The mechanism to which the present invention is directed is that mechanism which raises and lowers the infeed table or conveyor. Logs being arranged on the table can weigh several thousand pounds and the weight of the conveyor mechanism which supports the log can weigh additional thousands of pounds. The mechanism which adjusts the height of this very large weight must be rapid and precise. The log conveyance path defined by the table cannot be altered except in height and side way shifting, i.e., the entire table must be equally raised so as to be retained in a parallel plane.

The mechanism to achieve this task has progressed through several stages. In an early version of the table lift mechanism, the conveyor structure is supported on a series of lateral shafts hereafter referred to as lifting shafts. The lifting shafts were supported at each end on a pivotal crank arm, the connection to the crank arm being offset a precise distance from the crank arm's pivotal axis. Simultaneous pivoting of all of the crank arms simultaneously raise or lower the lifting shafts which in turn raise or lower the table, with every position of the table retained in a parallel plane.

As previously mentioned, each lifting shaft was supported on a set of crank arms. The crank arms of each set were connected through their pivotal axis by a pivoting shaft. Pivoting one crank arm of a set would apply torque to the pivot shaft resulting in rotation of the pivot shaft to pivot the other pivot arm of the set.

To insure simultaneous and equal movement of all the crank arm sets supporting the lifting shafts, a single actuator was utilized. A cylinder was coupled to one crank arm of a set. A rigid rod coupled the cylinder actuated crank arm to one crank arm of the next crank arm set and the additional crank arm sets would be coupled to the previous crank arm set by additional rods in the same manner.

The cylinder engaging one of the opposed crank arms connected together by the pivoting shaft, is controlled by the computer to actuate pivotal movement of the crank arms and corresponding raising and lowering of the infeed table.

The problem with the above-described mechanism is that the single actuator applies excessive torque to the pivotal shaft. Failure of the pivotal shaft and/or various connecting means used for connecting the crank arm and pivoting shaft are common.

A second version was developed whereby the pivotal shaft was eliminated and an actuator was applied to a crank arm on each side of the table. The problem with this design was the precise timing required of the actuators. The slightest difference in actuation is intolerable, as everything is tied together by support beams and the huge forces applied to the crank arms at each side causes severe damage when not equally applied.

BRIEF DESCRIPTION OF THE INVENTION

Applicant's solution to the problem was in the first instance to revert back to the single actuating cylinder. To avoid the torque problems, i.e., the torque being applied to a pivot shaft, a lifting beam connects the two crank arms and the actuating cylinder is connected to the lifting beam at a mid-point between the crank arms. The force thus applied to the lifting beam is a bending force which is readily accommodated by the beam, and both crank arms are equally forced by the actuating cylinder to the same precise pivotal position.

A secondary benefit is accomplished by providing the actuated crank arms at one end of the table and a second pair of crank arms at the other end, also interconnected by a lifting beam. A cable extended between the midpoints of the lifting beams, couple the two pairs of crank arms. The arrangement of the actuating cylinder is such that a pulling force is applied to the cable for raising the table whereas lowering thereof is accomplished by the weight of the table directed counter to the lifting force. This counter force maintains the cable always in tension. The cable insures that if something does prevent lowering of the crank arm at the opposite end, the cable will simply relax rather than buckle a rigid connecting rod as has happened on occasion in the past. The cable otherwise accomplishes the task equally as well as the rigid rod and is less expensive.

The invention will be more fully understood upon reference to the detailed description and drawings which follow.

DESCRIPTION OF THE PREFERRED EMBODIMENT

Figure 1:
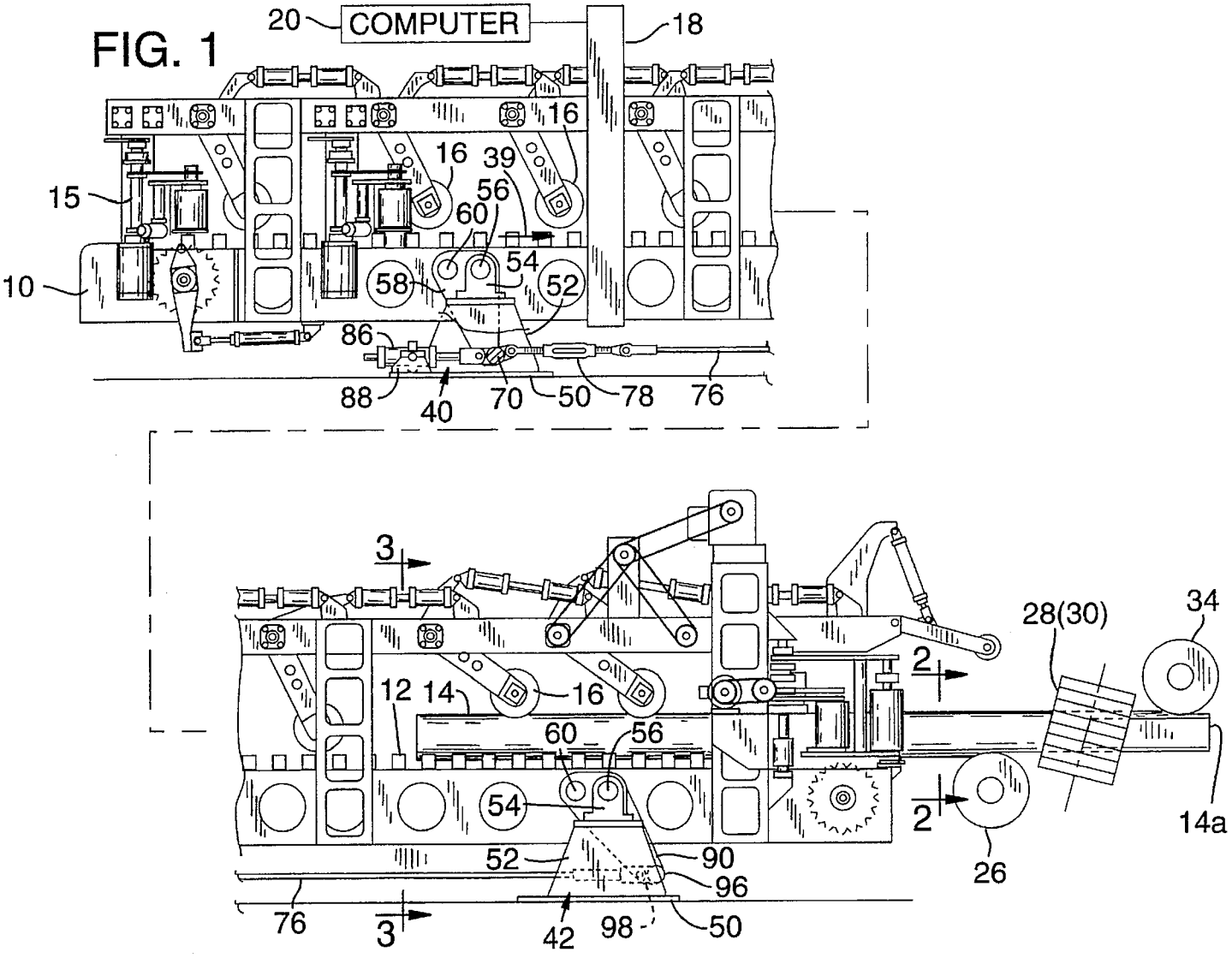
FIG. 1 is a view in diagram form of an infeed table for logs.
Figure 2:
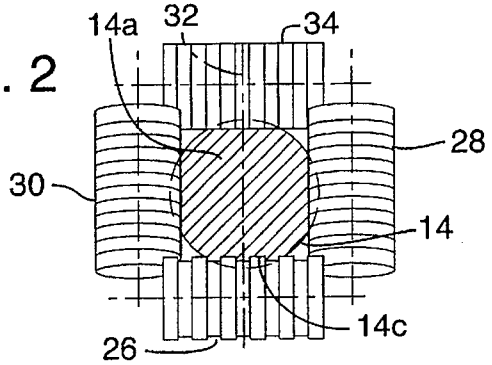
FIG. 2 is a view as viewed on view lines 2—2 of FIG. 1.

FIG. 1 illustrates an infeed table 10 for receiving and feeding logs to a log processing unit. In this embodiment, the infeed table receives and feeds logs to a chipper/saw line. Other embodiments will of course comprise cutting tools other than a chipper/saw line. Basically the infeed table 10 has a chain-type conveyor 12 for receiving and transporting a log 14. Hold down rollers 16 are provided to apply pressure to the top of a log to hold the log in position on the chain-type conveyor 12. As the log 14 is transported by the chain-type conveyor 12, it is scanned by a scanner unit 18. The scanner 18 scans the profile of the log and determines the position of the log 14 on the chain conveyor 12. The data from the scanner 18 is input to a computer 20 and the computer will establish the ideal cant that may be obtained from the log 14, it will establish the center line of the ideal cant in reference to the chain conveyor 12 and will control the lift and shift mechanism, which will later be detailed, for shifting the infeed table 10 transverse to the travel direction of the log 14 and for elevating or lowering the table 10 to position the log 14 in the proper attitude for a subsequent processing unit. In this embodiment, the next processing unit is a chipper unit as is illustrated in FIGS. 1 and 2.

In this embodiment, the bottom chipper 26 is in a fixed position and is not adjustable either upwardly or laterally. The side chippers 28 and 30 are adjustably movable toward and away from a center line 32 (FIG. 2). A top chipper 34 is adjusted upwardly and downwardly to accommodate the diameter of the log 14. FIG. 2 illustrates a log 14 and a resulting cant 14*a* that will be produced by the chipper unit. Since the bottom chipper 26 is in a fixed position, the log 14 received on the chain conveyor 12 may require repositioning either upwardly or downwardly to present the log 14 in the proper attitude to the chipper unit. Thus, the infeed table 10 will be raised (lifted) or lowered as determined by the computer. Similarly the infeed table 10 will be laterally shifted to align the log 14 with a known reference. In this embodiment, the bottom chipper 26 produces a spline on the resulting cant 14A. The log 14 is laterally shifted (in either direction) to produce the spline at the desired location on the cant 14A. It will be appreciated that other references may be utilized to position the log 14 particularly when the infeed table 10 is feeding the log 14 to other log processing units.

Figure 3:
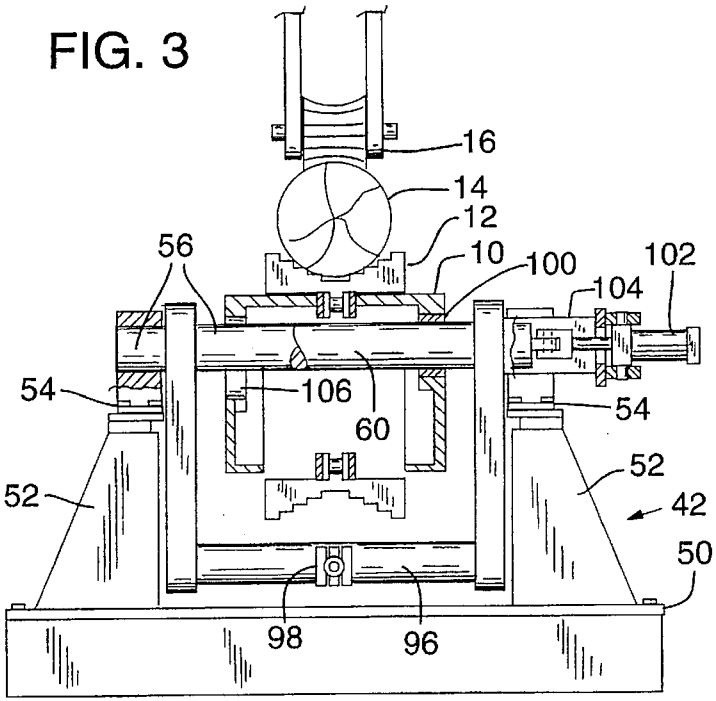
FIG. 3 is a view as viewed on view lines 3—3 of FIG. 1.
Figure 4:
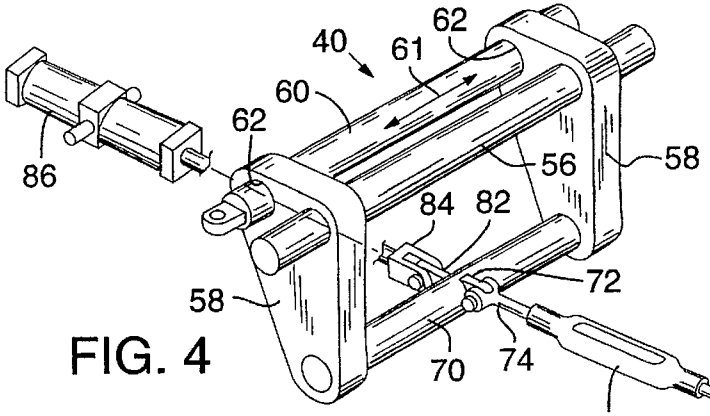
FIG. 4 is a perspective view of a lift mechanism of the infeed table of FIG. 1.
Figure 4:
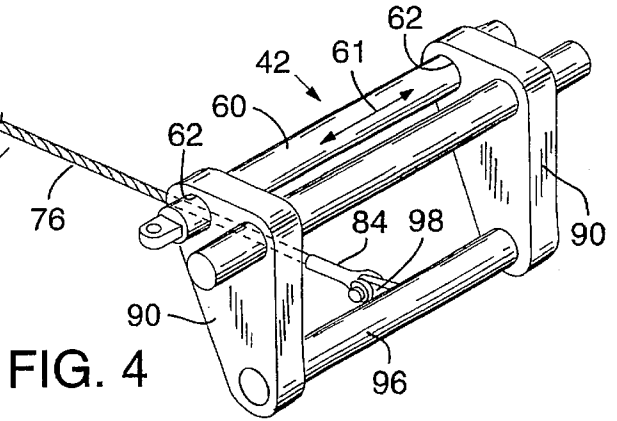

The infeed table 10 is supported on lift and shift mechanisms 40, 42 illustrated in FIGS. 1 and 4 with the lift and shift mechanism 42 being further illustrated in FIG. 3. In this embodiment, there are two lift mechanisms, i.e., 40 and 42. However, it will be appreciated that additional lift and shift mechanisms may be provided to facilitate elevating and shifting the infeed table 10. The number of lift and shift mechanisms utilized will depend in part on the length of the infeed table 10, the structural makeup of the infeed table 10, the weight of the infeed table 10 plus the weight of the largest log contemplated and so forth.

Each of the lift and shift mechanisms 40, 42 has a base plate 50. Pedestals 52 are fixedly mounted near each end of the base plates 50. A housing 54 is provided on the top of each pedestal 52 and is arranged to receive a pivot shaft 56. A pivot shaft 56 is provided on each lift and shift mechanism 40 and 42. Each of shafts 56 extends from one bearing housing 54 on one pedestal 52 to the other bearing housing 54 on the opposite pedestal 52. The pivot shafts 56 are rotatably mounted in the opposed housings 54 on each of the pedestals 52.

The lift and shift mechanism 40 has a crank arm 58 mounted to the pivot shaft 56 adjacent each of the pedestals 52. The crank arms 58 may or may not be non-rotatable with reference to the pivot shaft 56 and the shaft itself may be replaced with a pair of pivot pins at each pedestal. A support shaft 60 is rotatably and slidably mounted in bores 62 provided in each of the crank arms 58. The mounted support shaft 60 is substantially parallel to the mounted pivot shaft 56 and is offset at a distance from the pivot shaft 56. The support shaft 60 may be moved longitudinally in the bores 62 of the crank arms 58 as indicated by arrow 61. The infeed table 10 is fixedly mounted on the support shaft 60 between the spaced-apart crank arms 58.

Refer to FIG. 3 which illustrates the table 10 fixedly mounted to the support shaft 60 of the lift and shift mechanism 42 at 100. Only one of the table mounts is illustrated, however the opposite side of the table 10 is mounted to the shaft 60 in the same manner. The table 10 is similarly mounted to the support shaft 60 of the lift and shift mechanism 40. Conventional openings 106 are provided in the infeed table 10 to permit extending the pivot shafts 56 of the lift and shift mechanisms 40, 42 through the table 10 and to permit lifting and lowering the table 10 without interfering with the pivot shafts 56. The infeed table 10 is fixedly attached to the support shaft 60 and thus as the support shaft 60 is moved longitudinally in the bores 62, the infeed table 10 will be moved laterally with respect to the flow path (indicated by arrow 39 in FIG. 1) of the infeed table 10.

A lift beam 70 is extended between the crank arms 58 and is fixedly attached to each of the crank arms 58. The lift beam 70 is substantially parallel to the pivot shaft 56 and is preferably offset a greater distance from the pivot shaft 56 than the support shaft 60 is offset from the pivot shaft 56. The lift beam 70 has a bracket 72 arranged to couple an end 74 of a cable assembly 76. Another bracket 82 is provided for coupling the lift beam 70 to a cylinder rod 84 of a cylinder 86. Trunnion blocks 88 (FIG. 1) are mounted to the base plate 50 and are arranged to support the cylinder 86 in a conventional manner.

The cylinder 86 as its rod 84 is extended and retracted will thus pivot the crank arms 58 on the pivot shaft 56 extending between the pedestals 52 and since the support shaft 60 is offset from the pivot shaft 56, the support shaft 60 which is connected to and supports the infeed table 10 will elevate (lift) and lower the infeed table 10 as the crank arms 58 are pivoted on the pivot shaft 56. The infeed table 10 will thus be elevated and lowered by the appropriate pivoting of the crank arms 58. In this embodiment, fluid power is applied to the cylinder 86 to elevate (lift) the table 10 and the fluid is controllably released from the cylinder 86 to lower the table 10. The weight of the table 10 is sufficient to lower the table 10 by gravity, however, by controlling the release of the fluid the rate of lowering and the position to which it is lowered is controlled.

The lift and shift mechanism 42 as shown in FIGS. 1, 3 and 4 is similarly arranged and has crank arms 90 mounted on the pivot shaft 56 that extends between the opposed housings 54 on the pedestals 52. The pivot shaft is rotatably mounted in the housings 54 mounted on the pedestals 52.

Another support shaft 60 is extended between the crank arms 90 and is rotatably slidably mounted in the bores 62 provided in the crank arms 90. The support shaft 60 is substantially parallel to and offset at a distance from the pivot shaft 56. The support shaft 60 is fixedly attached to the infeed table 10 at 100 (FIG. 3).

A lift beam 96 is extended between the crank arms 90 and is fixedly attached to the crank arms 90. The lift beam 96 is substantially parallel to and offset at a distance from the pivot shaft 56. The lift beam 96 has a bracket 98 arranged for coupling an end 80 of the cable assembly 76.

The lift and shift mechanism 40 is thus mechanically coupled to the lift and shift mechanism 42 by the cable assembly 76. The cable assembly 76 includes a turn buckle 78 for adjusting the length of the cable assembly 76 so that the crank arms 90 of the lift and shift mechanism 42 will be pivoted in unison with the crank arms 58 of the lift and shift mechanism 40. The infeed table 10 will thus be elevated and lowered uniformly.

Each of the support shafts 60 of the lift and shift mechanisms 40, 42 are coupled to individual cylinders 102 (FIG. 3) for moving the support shafts 60 longitudinally in either direction in the bores 62 in their corresponding crank arms 58 and 90 of the lift and shift mechanisms 40, 42. The cylinders 102 are mounted on brackets 104 extending from the crank arms 58, 90 of the lift and shift mechanisms 40, 42. The cylinders 102 and brackets 104 are not illustrated in FIGS. 1 and 4 for drawing clarity. The cylinders 102 will move the support shafts 60 longitudinally as indicated by arrow 61 in FIG. 4. The cylinders 102 on the lift and shift mechanisms 40, 42 are preferably coupled to move in unison such that the infeed table 10 will uniformly be moved in either direction transverse to the product flow direction (indicated by arrow 39 in FIG. 1).

A log 14 which most often has been rotated to a horns down position is received on the chain-type conveyor 12 as illustrated in FIGS. 1 and 3. Typically the infeed table 10 has a known centering mechanism (generally designated by the numeral 15 in FIG. 1) that will substantially center the log 14 on the chain-type conveyor 12. The log 14 is supported on the chain 12 as best seen in FIG. 3. As the log 14 is transported by the chain-type conveyor 12, the log will pass the scanner system 18. The scan data from the scanner 18 is input to the computer 20 and the computer 20 will determine the ideal or optimum cant 14*a* that may be obtained from the log 14 as best seen in FIG. 2. The scan data from the scanner 18 also provides the computer with information about the position of the log 14 on the chain 12 and therefore will determine the position of the center line of the ideal cant 14*a* and also will determine the bottom edge 14*c* (surface) of the ideal cant 14*a*. From the input data, the computer will control the lift and shift mechanisms 40, 42 to properly position the infeed table 10 with relation to the chipper unit. The computer 20 will control the operation of the cylinder 86 to elevate (lift) or lower the infeed table 10 as required to place the intended bottom surface 14*c* of the ideal cant 14*a* in relation to the bottom chipper unit 26. The computer 20 will also control the operations of the cylinders 102 to shift the infeed table 10 laterally in either direction to adjust the position of the log 14 so that the spline generated in the cant 14A by the bottom chipper 26 will be at the desired location. The log 14 will thus be properly positioned according to the ideal cant 14*a* that is to be produced from the log 14 and the chain-type conveyor 12 will propel the log 14 into the chipper unit whereat the bottom, sides and top of the log 14 will be chipped away by the chipper unit and thus will produce the cant 14*a*.

The lift and shift mechanisms 40, 42 provide a uniform lifting and lowering motion to the infeed table 10. As seen in the figures, the force applied to the lifting beam 70 of the lift and shift mechanism 40 and the lifting beam 96 of the lift and shift mechanism 42 is applied near their center points and thus are only subject to a bending moment rather than a torsional twisting moment. This will apply a uniform force to each of the crank arms 58 and 90 of the lift and shift mechanisms 40, 42. The lift and shift mechanism 42 is mechanically coupled to the lift and shift mechanism 40 by the cable assembly 76 and thus the lifting and lowering of the infeed table 10 is accomplished by a single actuator, i.e., cylinder 86. By utilizing a cable assembly 76 to couple the lift and shift mechanism 42 to the lift and shift mechanism 40, there is a reduced chance to any damage to the coupling mechanism as the table 10 is lowered. Should the portion of the infeed table 10 that is supported by the lift and shift mechanism 42 fail to lower as the cylinder 86 is actuated to lower the infeed table 10, the cable assembly 76 will simply relax rather than being subject to a bending or twisting force that is commonly experienced with solid couplings that would couple the lift and shift mechanism 42 to the lift and shift mechanism 40.

Those skilled in the art will recognize that modifications and variations may be made without departing from the true spirit and scope of the invention. The invention is therefore not to be determined by the embodiments described and illustrated but is to be determined by the appended claims.

We claim:

1. An assembly for an infeed table that conveys logs and defines a feed path for the logs including mechanism to controllably raise and lower the table and the feed path accordingly, said assembly comprising:

longitudinal spaced apart rigid supports each defining a pair of laterally spaced apart pivotal connections and each pair of connections defining a pivotal axis:

a crank arm pivotally mounted at each pivotal connection thereby defining a pair of crank arms pivoted on each defined pivotal axis, and a support shaft extended between points of connection on the crank arms of each pair of crank arms, said points of connection equally spaced from the pivotal axis;

an infeed table supported by said support shafts;

a lift beam extended between a first pair of the crank arms at a position parallel to and offset from the axis of the pivotal connections;

an actuating member connected to a mid-point of said lift beam for applying pivotal movement of said lift beam and accordingly the interconnected pair of crank arms for pivotal raising and lowering of the support shaft extended between the pair of crank arms; and a connecting member connecting the pairs of crank arms in a lifting action of the actuating member for simultaneously raising and lowering the support shaft extended between the other pair of crank arms.

2. An assembly as defined in claim 1 wherein a lift beam is extended between the other pair of the crank arms at a position offset from the pivotal connections and said connecting member connected to the mid-points of each of said lift beams.

3. An assembly as defined in claim 1 wherein the connecting member is a flexible cable.

4. An assembly as defined in claim 2 wherein the connecting member is a flexible cable.

5. An assembly for an infeed table that conveys logs and defines a feed path for the logs including mechanism to controllably raise and lower the table and the feed path accordingly, said assembly comprising:

longitudinal spaced apart rigid supports defining a pair of laterally spaced apart coaxial pivotal connections at each support;

a crank arm pivotally mounted at each pivotal connection thereby defining pairs of crank arms pivoted on a common axis, and a support shaft extended between points of connection on the crank arms of each pair of crank arms, said points of connection spaced from the axis of the pivotal connections;

an infeed table supported by said support shafts; and a lifting beam interconnecting the crank arms of one of the pairs of crank arms for forced simultaneous pivoting of the pair of crank arms and a connection member connecting the pairs of crank arms to force simultaneous pivoting of said pairs of crank arms for lifting of the infeed table, said connection member including at least a flexible cable.

* * * * *